United States Patent [19]

Fischer et al.

[11] 3,989,342

[45] Nov. 2, 1976

[54] CHAMBERED ARC SNUFFING TUBE FOR BUSHING ASSEMBLY

[75] Inventors: Allen H. Fischer, Affton; John S. Schwarz, St. Louis, both of Mo.

[73] Assignee: International Telephone and Telegraph Corporation, New York, N.Y.

[22] Filed: Dec. 15, 1975

[21] Appl. No.: 640,973

Related U.S. Application Data

[63] Continuation of Ser. No. 361,424, May 18, 1973, abandoned.

[52] U.S. Cl. ..... 339/111; 200/149 A; 339/60 R; 339/112 R

[51] Int. Cl.[2] ..... H01R 13/52

[58] Field of Search ..... 339/111, 112 R, 60 R, 339/60 C; 200/144 C, 148 C, 148 G, 149 A

[56] References Cited

UNITED STATES PATENTS

| | | | |
|---|---|---|---|
| 2,131,000 | 9/1938 | Petermichl | 200/149 A |
| 2,223,975 | 12/1940 | Traver | 200/149 A |
| 3,512,118 | 5/1970 | Leonard | 339/60 R |

FOREIGN PATENTS OR APPLICATIONS

| | | | |
|---|---|---|---|
| 205,650 | 9/1939 | Germany | 200/149 A |

*Primary Examiner*—Roy Lake
*Assistant Examiner*—DeWalden W. Jones
*Attorney, Agent, or Firm*—James B. Raden; William J. Michals

[57] ABSTRACT

A load break bushing assembly for high voltage electrical systems is disclosed. The bushing assembly is normally connected to a stationary object such as a transformer to dispose a female electrode receiving bore for reception of a terminator electrode. The bore has at its mouth end a protective, arc-snuffing tube of suitable arc suppressant material. The tube has radial openings in the bore leading to an annular chamber within the tube walls, the chamber exposing a large surface area to the ionized gases tending to quench the generated gas on load break and to break up the pressure wave which follows the withdrawal of the arc follower electrode. Various filter materials may be inserted in the chamber if desired to enhance its arc extinguishing characteristics.

6 Claims, 7 Drawing Figures

CHAMBERED ARC SNUFFING TUBE FOR BUSHING ASSEMBLY

This is a continuation of application Ser. No. 361,424 filed May 18, 1973, now abandoned.

BACKGROUND OF THE INVENTION

Load break connectors are well-known in the high voltage electrical distribution art. As presently constituted these connectors generally include a removable terminator and a stationary bushing. It is to an improvement in bushing construction that the present invention is directed.

In such connectors as generally known, the terminator comprises a tubular body of insulating material (usually elastomeric) within a semiconductive outer shell. The insulating body has a longitudinal bore within which is disposed the axial connector electrode, the electrode being spaced from the bore walls of the terminator a distance sufficient to receive and mate with the tubular bushing body.

The receiving bushing assembly comprises a tubular insulating body (usually elastomeric) with an outer conductive or semi-conductive shell. Within the bore for most of its axial length is a metallic conductive thin-walled tube, usually copper. At one end, the conductive tube has secured therein a suitable member adapted to connect to a transformer bushing or the like.

At its other end, the terminator mating end, the metallic tube is inserted within the bore of the body. The open mouth of the conductive tube is threaded, the threaded end terminating and being recessed a distance within the bushing body. Either within the threaded section or further within the conductive tube, a tubular connector insert sleeve of metallic material is fitted. This insert sleeve may be split or otherwise configured to receive and grasp the terminator electrode in a tight-fitting conductive relationship.

In the mouth of the bushing is inserted an arc snuffing insert. The insert is tubular and is configured to fit tightly in the bushing assembly mouth. The cylindrical outside wall of the insert is threaded at one end to mate with the threaded conductor tube and hold the insert in place.

The insert is molded or otherwise suitably fabricated of a plastic material known to aid in extinguishing an arc due to the inherent properties of the material. One family of such materials is known as polyoxymethylene of the type known by the trademark Delrin. Other known materials may be used for this purpose.

As is known, such materials tend to extinguish an arc drawn between an electrode being extracted from the bushing and the tubular sleeve conductor end.

In extinguishing the arc, the material of the insert generates gases when subjected to the heat of an arc. The gas generated has a deionizing effect on the gases and acts to confine and extinguish the arc. The type of extinguishing tubes known in the art have the internal bore wall as the surface contacted by the arc in generating gases.

SUMMARY OF THE INVENTION

The present invention uses a loadbreak bushing of any known and suitable design. The bushing as in the prior art receives the terminator electrode in conductive contact with a conductive sleeve of the bushing to make a high voltage connection capable of being broken. In the bushing, an arc extinguishing insert of new and improved design is provided.

This insert is tubular and is configured to provide an inner chamber within the walls of insert. The chamber is in communication with the insert bore to provide access for an arc into the chamber thereby to enhance the extinguishing characteristics of the extinguishing tube.

In one form of improved snuffer tube we use two coaxial sleeves with annularly stepped walls which are assembled together to form an annular cavity between the adjacent steps. The inner sleeve has radial perforations providing communication between the inner bore and the cavity.

Additionally, filter materials of various metallic or insulating materials may be placed in the cavity to aid in extinguishing the arc. Some filter materials employed have comprised ceramic rods or spheres, pellets and ceramic paper wound about the inner sleeve. Naturally such materials must be resistant to corrosion or breakdown at the elevated temperatures to be encountered in proximity to an arc.

It is therefore an object of the invention to provide a new and improved arc extinguishing tube for use in a load break bushing.

It is a further object of the invention to provide an arc extinguishing tube for a load break bushing, the tube having an internal cavity in communication with the tube bore for extinguisning an arc in the bushing.

It is a still further object of the invention to provide a multiple sleeve arc extinguishing tube with at least one cavity between the tube sleeves, the cavity being in communication with the area of the bushing subject to the arc.

It is a still further object of the invention to provide an arc snuffer tube with a cavity in communication with the tube bore, the cavity being filled with suitable filtering materials.

These and other objects, features and advantages of the invention will become apparent from the detailed description viewed in conjunction with the drawings of which the following is a brief description.

DETAILED DESCRIPTION OF THE DRAWINGS

Figure 1:
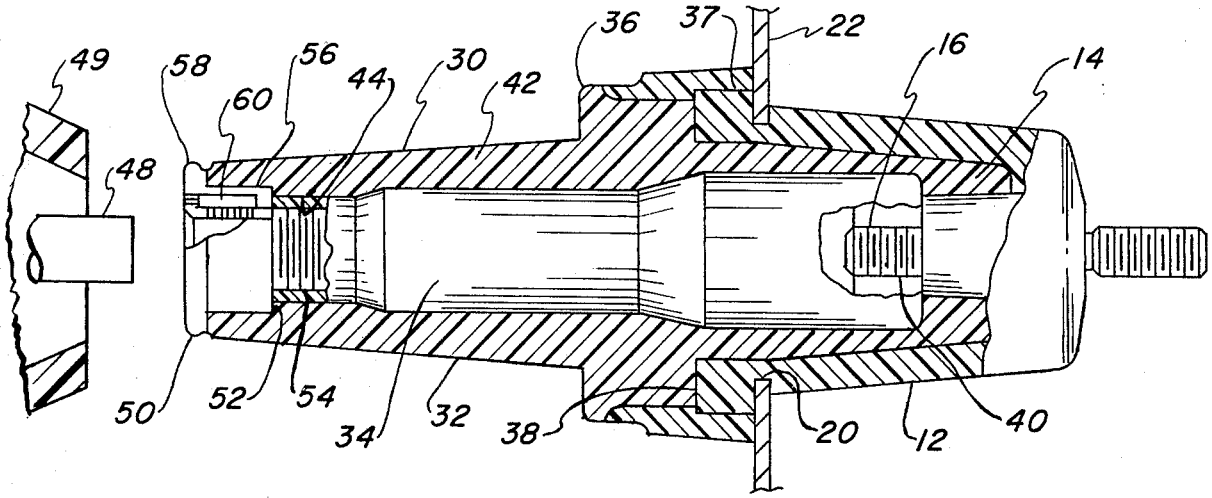
FIG. 1 is a side view of a bushing, the bushing being broken away to show the interior thereof.

Turning now to the drawings, in FIG. 1, there is shown a fully assembled insert-receiving, cup-shaped bushing well 12 disposed about a mounting bushing 14 with threaded stud 16 extending from the bushing well. As shown, the bushing and well may, in the final product, be a one-piece molded member. The mounting bushing 14 is suitably connected to primary electrical distribution apparatus such as a transformer or switch gear in any form known in the art. The bushing well 12 may be suitably molded or otherwise formed of comparatively rigid insulating material such as an epoxy, and is designed to mount within a flanged opening 20, the metal flange 22 otherwise rendering the connection of the well to the mounting bushing waterproof. The connection of the well 12 to the flange 22, mounting bushing 14 and stud 16 may, for all practical purposes, be considered a permanent one.

Mounted on stud 16 and within the bushing well, is a tubular bushing body 30 having a suitable outer shell 32 of elastomeric material tightly surrounding a conductive tubular sleeve 34 of copper or the like. The outer shell 32 is dimensioned to fit tightly (with an interference fit) within the well opening with the elongated wall surfaces of the two members in a large area interference fit, to provide a degree of contact necessary both for water-proofing purposes and to prevent large air voids within which corona may form. The bushing body 30 has an outward peripheral raised area 36 designed to rest against and seal the joinder to the flange 22. The raised area has an annular recess 37 adapted to mate with and receive the peripheral exposed edge 38 of the bushing well to produce a waterproof joinder of the bushing body, well and flange.

The inner conductive shell 34 has a threaded opening 40 at one end for mating with the bushing stud 16 in a tight fit designed to pass current of high magnitudes and at elevated voltages across the screw threaded connection. The inner shell 34 is continuous and imperforate throughout its body portion 42 leading to the mouth end opening 44 which may be internally threaded at a location recessed within the body mouth opening. Suitable spring contactors may be recessed in the conductive shell to make a gripping contact with the electrode assembly 48 of the electrode of the terminator 49 shown partially in FIG. 1.

In the normal usage, an arc snuffer tube 50 is threadedly mounted in the body mouth opening 44, the snuffer tube having a shoulder 52 which enters the body mouth to fit tightly therein and waterproof the mouth entry. The snuffer tube has an external thread 54 about one end section thereof to mate with the inner threaded mouth section 44 of the bushing body. Tube 50 has a raised section 56 adjacent the threaded section and a cylindrical head 58 used to aid in engaging the bushing 30. The snuffer tube 50 is made of any known insulating material of such as polyoxymethylene or melamine compounds which act to snuff and extinguish a high voltage arc generated by withdrawal of a high voltage electrode from the snuffer tube bore. The structure described to this point in the detailed description including a bushing insert of any known type is well-known in the art.

In normal usage, the snuffer tube is screwed tightly into the threaded section of the bushing.

The insert tube 50 embodying our invention in a general sense is exteriorly configured in the manner known in the art and described above. Our insert tube as shown in FIG. 1 has an internal cavity 60 concentrically disposed about the insert bore. The cavity 60 is annular and is in communication with the insert bore by way of a series of radial perforations in the bore of the insert.

Figure 3:
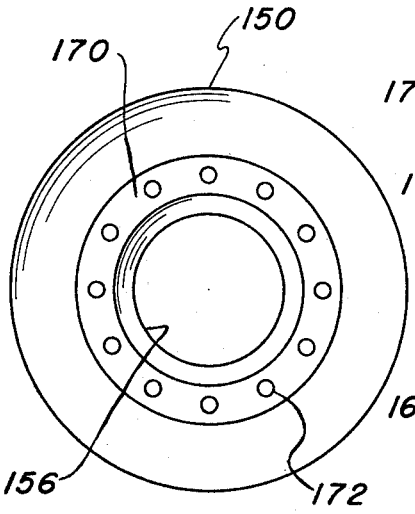
FIG. 3 is an end view of the tube of FIG. 2.
Figure 2:
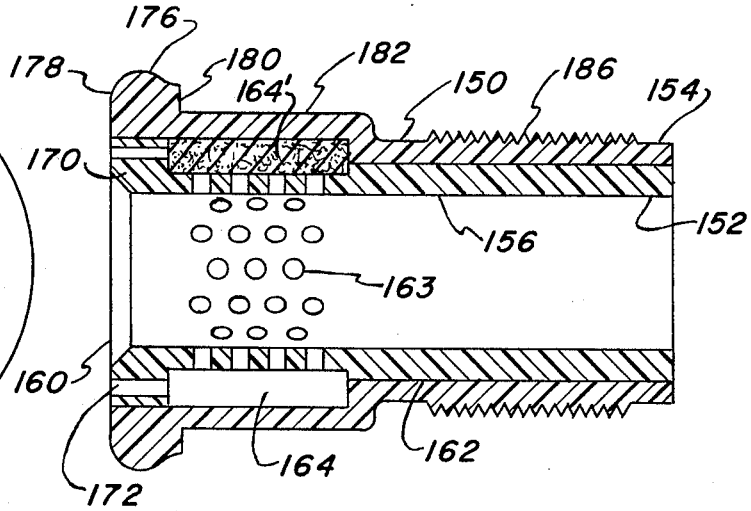
FIG. 2 is a sectional view through the center of the arc extinguishing tube employing a first embodiment of our invention.

In FIGS. 2 and 3 we show an embodiment of an arc snuffer tube 150 using our invention. Tube 150 is comprised of an inner sleeve 152 and an outer sleeve 154 assembled together. Both sleeves are molded or otherwise formed of material suitable for arc extinguishing purposes, such as the examples previously noted.

The inner sleeve 152 has a smooth inner bore 156 and a regular outer wall for most of the tube height. Adjacent the entry end 160 of the tube 152, the outer wall 162 of the inner sleeve 152 is annularly recessed to form part of the chamber 164. A regular series of radially directed perforations or apertures 163 in the inner bore 156 reach into chamber 164. The entry end of the inner sleeve has an outwardly extending flange 170. Perforations or apertures 172 in the flange communicate with the chamber to vent the chamber to the ambient surroundings. The outer sleeve 154 at the entry end has a flange 176 forming a coplanar wall 178 with the entry end of flange 170. The flange terminates in a shoulder 180 designed to abut against the mouth of the bushing bore similar to the known snuffer tubes. A stepped inner wall 182 of sleeve 154 completes and encloses the chamber 164. As discussed hereinafter, chamber 164 may include filtering means 164' as exemplified in FIG. 2. A step in the outer wall of sleeve 154 leads into the threaded outer section 186 of the sleeve to fasten the tube within a bushing as shown in FIG. 1.

The two sleeve sections are dimensioned for a tight fit of the inner sleeve within the outer sleeve to permit the two sleeves to be assembled without the need for any permanent holding members.

Figure 5:
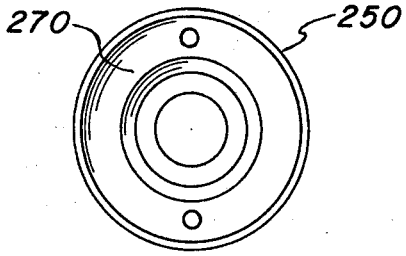
FIG. 5 is an end view of the tube of FIG. 4.
Figure 4:
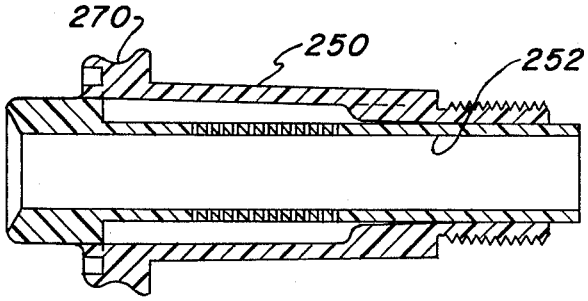
FIG. 4 is a sectional view through the center of a tube employing the second embodiment of our invention.

In FIGS. 4 and 5 we show a further embodiment of an arc snuffer tube 250 using our principle. Snuffer tube 250 is generally similar to tube 150 except that the inner sleeve 252 is adapted to extend beyond the end wall of the bushing and in normal usage to enter into the annular terminus cavity about the terminator electrode. The inner cavity has openings only about the inner sleeve, 252, and does not have exit ports such as 172 in FIG. 2. Thus the inner sleeve extends beyond its flange 270 in a tubular fashion.

Figure 7:
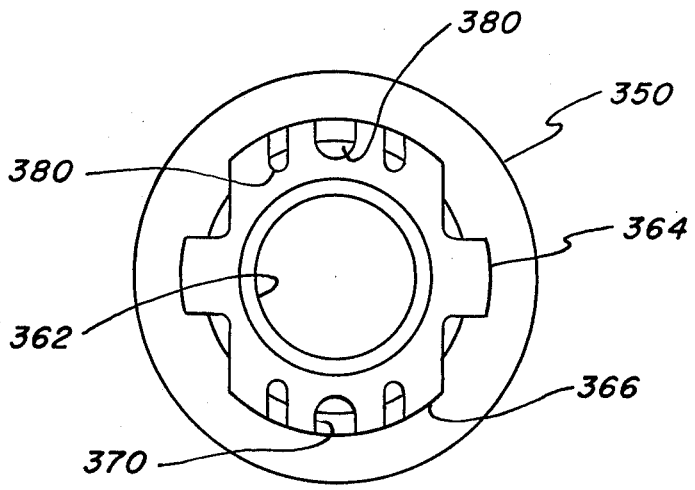
FIG. 7 is an end view of the tube of FIG. 6.
Figure 6:
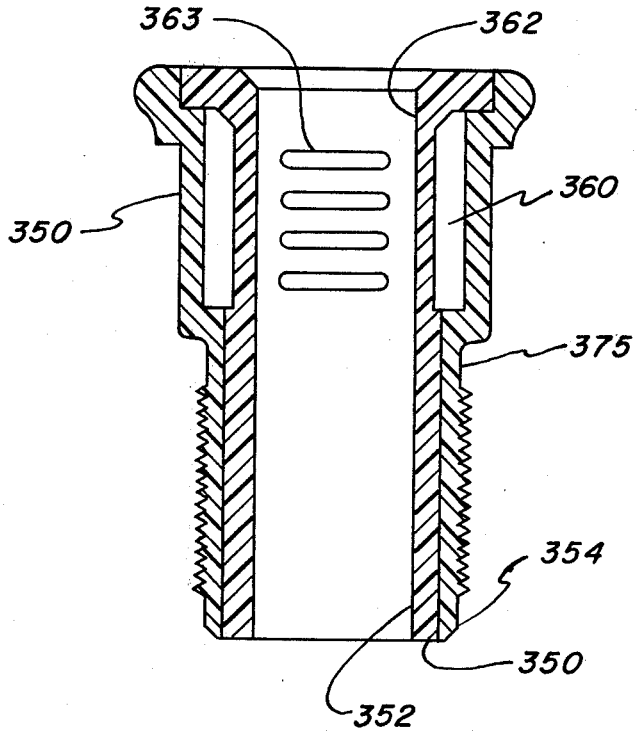
FIG. 6 is a sectional view through a snuffer tube manufactured according to a third embodiment of our invention.

In FIGS. 6 and 7, we show another form of snuffer tube 350 using our invention. The tube 350 is comprised of an inner sleeve 352 and an outer sleeve 354 joined together and heat stacked to form a unitary tube. The space between the tubes form an annular cavity 360 the cavity being generally rectangular in cross section. Communication between the tube bore 362 and the cavity 360 is affected by means of elongated slots 363 through the side wall of the inner sleeve. In FIG. 6 elongated slots 363 are shown as comprising four parallel slots which are transverse to the axis of inner sleeve 352. The section of sleeve 352 not shown in FIG. 6 also includes four parallel slots similarly disposed with reference to the axis of sleeve 352.

The end flange of the inner sleeve is configured with opposing ears or tabs 364 and opposed spaced segments 366, the segments being essentially at right angles to the tabs in the common face plane. The segments are notched as indicated by numerals 370. The bore 362 of the inner sleeve 352 is generally cylindrical as shown, and is slotted as indicated.

The outer sleeve 354 has its bore designed to mate with the cylindrical outer wall of the inner sleeve, the bore being stepped to provide the annular cavity 360 in cooperation with a like step on the inner sleeve. The outer wall of the outer sleeve is recessed in the area between the body of the tube and the main threaded end section 375.

The end flange of the outer sleeve has a circular outer surface and an inner surface configured to mate with and receive the tabs and segments of the inner sleeve. As can be seen best in FIG. 7, a portion of the notches are uncovered, as indicated at 380 to provide venting from the cavity to the ambient surroundings external to the bushing.

Using our invention, we have provided a snuffer tube which has no moving parts to wear out. The snuffer tube deionizes the gases formed by the arc between electrode and bushing conductor.

As alluded to in the detailed description of FIG. 2, various filtering members may be introduced into the chamber prior to assembly to cool the gases produced by the arcing, and to trap contaminants which would otherwise be released into the bushing conductor cavity. Filtering media which have been used as fillers include (1) beryllia rods, (2) Ceramic fibers as sold under the trademark Kaowool, (3) alumina spheres and (4) Ceramic papers wound on the inner sleeve within the cavity.

Further by venting the snuffer tube chamber to the atmosphere creates a pressure differential during load break to cause the gases to pass through the filtering medium before the electrode is fully withdrawn — although, in some cases, venting may not be required.

With a snuffer tube in position in the bushing, a terminator may be mated with the bushing. The central electrode arc follower of the terminator enters the snuffer tube bore with slight clearance and thereafter the electrode contacts the spring contacts in the bushing body to complete the electrical circuit from electrode to bushing conductive sleeve.

As the terminator is removed, the follower passes through the snuffer tube bore exposing successively greater numbers of perforations to ionized gases and the gases within the tube bore. Through these perforations, the chamber is placed in communication with the tube bore. The heated and ionized gases produced by the arcing and by the gas generation of the snuffer tube material pass through the perforations into the cavity. Within the cavity greater areas of the snuffing material are exposed to the arc gases. Further the gases pass through any of the filtering media in the chamber and slow the passage of gases, de-ionize and cool the gases to render the gases harmless. The gases pass through the venting openings and escape from the chamber.

To provide an idea of the relative proportions of the chamber of FIGS. 2 and 3 we have found that an annular chamber having its length slightly greater than the bore diameter and having a depth of about one fourth of its height has proved successful. With the embodiment of FIG. 4 a chamber of approximately 3.5 times the bore diameter was used with a depth of less than one half of the bore diameter.

Perforations have been provided to an extent necessary to provide a reasonable amount of communication without weakening the physical strength of the sleeve wall.

We claim:

1. A load bread connector comprising, in combination:

a stationary bushing;

a removable terminator; and, an arc snuffing member insert received within said stationary bushing;

wherein:

said removable terminator comprises a tubular body of insulating material and includes an axial terminator electrode coaxially mounted within the longitudinal bore of said tubular body, said electrode being spaced from the bore walls of said tubular body and said electrode having a tubular arc follower member of arc extinguishing material at its end portion thereof;

said stationary bushing comprises a tubular body of insulating material which is received between the bore walls of said tubular body of said removable terminator and said electrode, said stationary bushing having a mouth opening at one end thereof and a conductive tube disposed within the longitudinal bore of said tubular body of said stationary bushing, for receiving said electrode in conductive relationship therewith, and said conductive tube being spaced a given distance from said mouth; and, said arc snuffing member is inserted into and fixedly mounted in said mouth of said stationary bushing, said snuffing member comprising an arc extinguishing material and said member including a generally tubular outer surface and an inner tubular bore for receiving the electrode of a terminator, said member including at least one cavity between said inner tubular bore and said tubular outer surface, and a plurality of fixed perforations in said member disposed substantially toward said mouth of said stationary bushing and extending from said inner tubular bore into said cavity wherein said cavity is in communication with said inner tubular bore after the arc is extinguished by said arc extinguishing materials for receiving arc-generated gases from said inner tubular bore during withdrawal of said electrode through said inner tubular bore when said fixed perforations are exposed by the withdrawal of said arc follower member from said inner tubular bore.

2. The load break connector according to claim 1, wherein there are means venting said cavity exteriorly of the bushing.

3. The load break connector according to claim 1, wherein there are filtering members disposed in said cavity for filtering or de-ionizing gases passed into said cavity.

4. The load break connector according to claim 1, wherein said cavity of said snuffing member comprises an annular chamber coaxial with the member bore and spaced therefrom by a wall of said snuffing member.

5. A load break connector comprising, in combination:

a stationary bushing;

a removable terminator; and, an arc snuffing member insert received within said stationary bushing;

wherein:

said removable terminator comprises a tubular body of insulating material and includes an axial terminator electrode coaxially mounted within the longitudinal bore of said tubular body, said electrode being spaced from the bore walls of said tubular body and said electrode having a tubular arc follower member of arc extinguishing material at its end portion thereof;

said stationary bushing comprises a tubular body of insulating material which is received between the bore walls of said tubular body of said removable terminator and said electrode, said stationary bushing having a mouth opening at one end thereof and a conductive tube disposed within the longitudinal bore of said tubular body of said stationary bushing, for receiving said electrode in conductive relationship therewith, and said conductive tube being spaced a given distance from said mouth; and, said arc snuffing member is inserted within said entry opening of said stationary bushing, said snuffing member including an inner bore to communicate with the opening of said stationary bushing, and wall structure for engaging said stationary bushing opening to affix the member therein, said snuffing member comprised of arc extinguishing material emissive of gases upon generation of an arc in said inner bore, and said snuffing member comprising an inner sleeve having an inner dimension defining said bore, and an outer sleeve having an outer surface providing said bushing engaging wall, said sleeves in surface contact along mating walls thereof, at least one annular cavity between said inner and outer sleeves, a first plurality of fixed apertures disposed generally at the entry end of said inner sleeve and extending through said inner sleeve from said inner bore to said cavity wherein said cavity communicates with said inner bore after said arc is extinguished by said gases upon initial movement of said electrode and wherein the communication of said cavity with said inner bore occurs upon further movement of said electrode, a flanged end wall of said snuffing member adapted to rest externally of said stationary bushing when said snuffing member is fully assembled into said stationary bushing, and a second plurality of apertures in said end wall venting said cavity to the atmosphere external to said connector.

6. The load break connector according to claim 5, wherein there is filtering or de-ionizing means in said cavity, said filtering means being resistive to breakdown at elevated temperatures.

* * * * *

PO-1050
(5/69)

UNITED STATES PATENT OFFICE
CERTIFICATE OF CORRECTION

Patent No. 3,989,342 Dated November 2, 1976

Inventor(s) A. H. Fischer-J. S. Schwarz

It is certified that error appears in the above-identified patent and that said Letters Patent are hereby corrected as shown below:

Column 5, line 59 change "bread" to --break--.

Signed and Sealed this

Twenty-second Day of February 1977

[SEAL]

*Attest:*

RUTH C. MASON
*Attesting Officer*

C. MARSHALL DANN
*Commissioner of Patents and Trademarks*